United States Patent [19]

Sanders

[11] Patent Number: 4,612,685

[45] Date of Patent: Sep. 23, 1986

[54] ORGANIZER CLIP DEVICE

[76] Inventor: Calvin E. Sanders, P.O. Box 1246, Keaau, Hi. 96749

[21] Appl. No.: 746,505

[22] Filed: Jun. 19, 1985

[51] Int. Cl.[4] ..... B42F 1/02

[52] U.S. Cl. ..... 24/67.9; 24/67 R; 40/11 A; D19/65

[58] Field of Search ..... 24/67.9, 67 R, 545, 24/546, 547; D19/65; 40/11 A

[56] References Cited

U.S. PATENT DOCUMENTS

| | | | |
|---|---|---|---|
| D. 33,241 | 9/1900 | Gross | D19/65 |
| 1,167,734 | 1/1916 | Anderson | 24/547 |
| 1,247,087 | 11/1917 | De Noyer . | |
| 1,347,942 | 7/1920 | Forward | 40/11 A |
| 1,449,684 | 3/1923 | Long et al. . | |
| 1,504,141 | 8/1924 | Ritter | 40/11 A |
| 1,565,501 | 12/1925 | Robinson, Jr. | 24/546 |
| 1,783,484 | 12/1930 | Ross . | |
| 2,502,289 | 3/1950 | Szent-Gyorgyi . | |
| 2,642,638 | 6/1953 | Larrabee | 24/67.9 |
| 3,348,271 | 10/1967 | Miller . | |
| 3,564,674 | 2/1971 | Chaplin . | |
| 3,840,943 | 10/1974 | Langwell | 24/67.9 |
| 4,300,268 | 11/1981 | Wilson | 24/67.9 |
| 4,382,617 | 5/1983 | Fortier . | |
| 4,458,386 | 7/1984 | Fernandez . | |
| 4,480,356 | 11/1984 | Martin . | |

FOREIGN PATENT DOCUMENTS

| | | | |
|---|---|---|---|
| 121749 | 7/1946 | Australia | 24/546 |
| 444860 | 5/1927 | Fed. Rep. of Germany | 24/547 |
| 457163 | 3/1928 | Fed. Rep. of Germany | 24/547 |
| 814290 | 9/1951 | Fed. Rep. of Germany | 24/67.9 |
| 2609308 | 8/1977 | Fed. Rep. of Germany | 24/67.9 |
| 321125 | 6/1957 | Switzerland | 24/547 |

*Primary Examiner*—Victor N. Sakran

*Attorney, Agent, or Firm*—Schwartz, Jeffery, Schwaab, Mack, Blumenthal & Evans

[57] ABSTRACT

Disclosed is a clip device which retains multiple materials in a separated and organized fashion and which is reversible in design to restore the clip to its undeformed tension if excessively deformed. The clip comprises an oval portion which continues into an essentially rectangular portion positioned on the oval portions between the arcuate ends thereof, with the rectangular portion having a width at least equal to the width of the oval.

15 Claims, 3 Drawing Figures

ORGANIZER CLIP DEVICE

BACKGROUND OF THE INVENTION

1. Field of the Invention

The present invention relates to an improved clip device which, in addition to a clipping function, also serves to separate and organize the clipped material.

2. Prior Art

The common paper clip is an article of great utility at home and in the office. Because of this utility, a variety of designs have been proposed. For example, U.S. Pat. No. 1,783,484 discloses a paper clip which consists of two loops at each end of the clip with one loop being nested inside of the other. This design differs from the standard paper clip which has two loops at one end and only one loop at the other end of the clip. According to U.S. Pat. No. 1,783,484, the dual double loop design provides for insertion of material to be clipped at either end of the clip. More recently, U.S. Pat. No. 4,480,356 has disclosed a double-grip clip which has two gripping units adjacent one another to improve the gripping ability of the clip.

Other prior art clips are as follows: U.S. Pat. Nos. 1,247,087; 1,449,684, 2,502,289; 3,348,271; 3,564,674; 4,382,617; and 4,458,386.

While the prior art paper clips serve useful purposes, the clips evidence certain limitations. For example, for the most part, the clips serve to retain the clipped materials together in one group. Because the user often finds himself/herself with two or more sets of materials to be kept separate, the prior art clips are found lacking. Additionally, in the nested arrangements found in the prior art clips, i.e., the loops being positioned within each other, once the loops are separated outside the elasticity range, the loops remain in the deformed position, unless the user attempts to restore the clips to their original, undeformed position. In either case, the clip typically does not demonstrate its original and advantageous gripping ability once excessively deformed.

SUMMARY OF THE INVENTION

It is therefore an object of the present invention to provide a clip device which overcomes the aforementioned shortcomings of the prior clips.

Specifically, an object of the present invention is to provide a clip device comprising clipping portions for retaining materials in a separated arrangement, thus organizing the materials in an easily retrievable manner.

A further object of the invention is to provide a clip device which exhibits a reversible structure, the result of which is to restore the clip which has been excessively deformed to the desirable predeformation clipping tension.

Still another object of the present invention is to provide a clip device which has one loop end which extends sufficiently to provide a handle for carrying the clipping device.

Yet a further object of the present invention is to provide a clip device which exhibits similar results in an inverted position.

Still another object of the present invention is the provision of a clipping device that firmly secures the materials to be held, and yet allows for the easy removal of material therefrom.

In accomplishing the foregoing objects, there has been provided in accordance with the present invention, a clip device for retaining and organizing papers in separate filing portions, formed from a single, continuous length of multiply bent resilient material to define a plurality of loops, comprising an oval portion which includes leg members connected by first and second arcuate portions, and an essentially rectangular portion continued from the oval portion and positioned on the oval portion between the first and second arcuate portions, the width of the rectangular portion being at least equal to the width across the oval portion. More specifically, the clip device comprises a first leg extending a first distance in a first direction from one end of the resilient material, a first arcuate portion extending from the first leg, a second leg extending from the arcuate portion a second distance in a second direction substantially opposite the first direction, a second arcuate portion extending from the second leg, a third leg extending from the second arcuate portion a third distance substantially in the first direction, a first square loop portion extending from the third leg, a fourth leg extending from the first square loop portion a fourth distance substantially in the second direction, a second square loop portion extending from the fourth leg, and a fifth leg extending from the second square loop a fifth distance substantially in the first direction.

BRIEF DESCRIPTION OF THE DRAWING

The above and other objects and advantages will become apparent from the following description and accompanying drawings, wherein.

DETAILED DESCRIPTION OF THE PREFERRED EMBODIMENT

Figure 1:
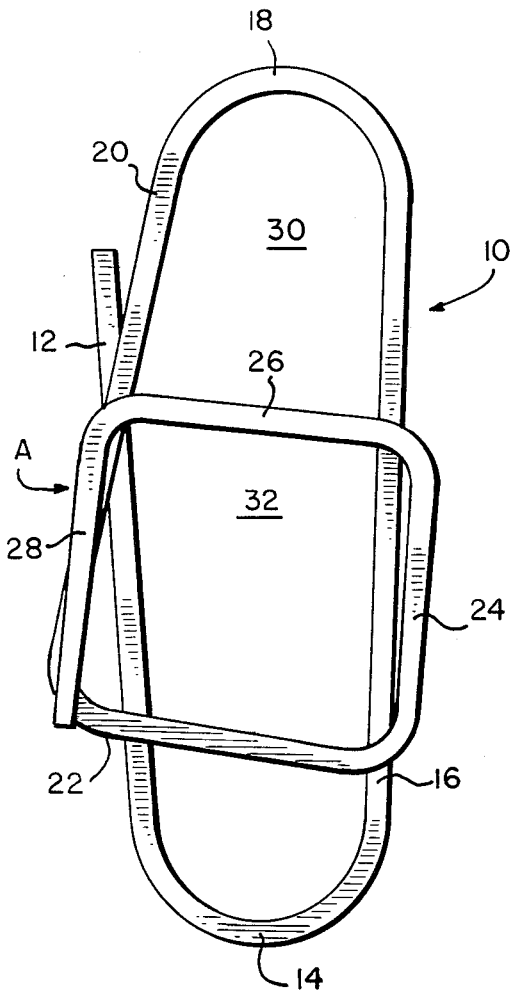
FIG. 1 is a front plan view of the clip device according to the present invention.

The present clip device will first be described with reference to the figures of drawing. Referring first to FIG. 1, the clip 10 comprises a series of legs and arcuate and square loops formed from a single, continuous length of resilient, heavy guage wire material. Extending from one end of the length of the resilient material is a first leg 12. The first leg 12 continues a first distance in a first direction and extends to a first arcuate portion 14. The arcuate portion 14 continues into a second leg 16 which extends a second distance, preferably a distance greater than the distance of the first leg 12. The second leg 16 extends in a direction substantially opposite that of the first leg 12. The second leg extends to a second arcuate portion 18 which continues to and terminates into a third leg 20.

The third leg 20 extends generally in the direction of the first leg 12. Preferably, the first leg 12 and the third leg 20, while extending in the same general direction, are not exactly parallel to one another for reasons to be discussed below. Furthermore, the length of the third leg 20 is preferably less than the length of the second leg 16.

The third leg 20 terminates into a first substantially square loop 22 which continues to and terminates into a fourth leg 24. The distance across the square loop from the third leg 20 to the fourth leg 24 is at least equal to, but preferably slightly greater than the distance between the first leg 12 and the second leg 16. Accordingly, the square loop portion of the clip occupies a plane above, but immediately adjacent the plane occupied by the first and second legs.

The fourth leg 24 terminates into a second square loop portion 26 which continues to and terminates into a fifth leg 28. Leg 28 extends in the same general direction as the third leg 20 and the first leg 12. Similar to the first square loop portion 22, the second square loop portion 26 extends, from the fourth leg 24 to the fifth leg 28, a distance at least equal to and preferably slightly greater than the distance between the second leg 16 and the third leg 20. Thus, the portion of the clip comprising the fourth leg 24, the second square loop portion 26, and the fifth leg 28 occupy a plane above, but immediately adjacent the plane occupied by the portion of the clip comprising the second leg 16, the second arcuate portion 18, and the third leg 20.

Figure 2:
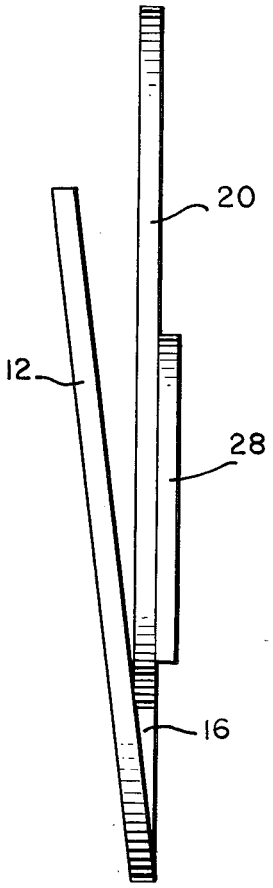
FIG. 2 is a side elevation view in the direction of arrow A of FIG. 1.

Hence, the present clip comprises a resilient material which is multiply bent into a series of substantially arcuate and square loops occupying adjacent planes. Reference is made to FIG. 2 which illustrates the present clip in side elevation view taken in the direction of arrow A in FIG. 1. FIG. 2 illustrates the overlay structure of the present clip. Third leg 20 forms a part of an essentially oval structure 30 which further includes first arcuate portion 14, second leg 16 and second arcuate portion 18. This oval structure overlays the upper portion of the first leg 12 and can be considered to include the lower portion of the first leg. Additionally, a further overlay results from the essentially rectangular structure 32 formed from the first square loop portion 22, the fourth leg 24, the second square loop portion 26, and the fifth leg 28. The phrase "essentially rectangular structure," as presently used, is understood to also include an essentially square structure.

The essentially rectangular structure 32 is overlayed on the essentially oval structure 30 between the first and second arcuate portions of the oval structure, generally in the vicinity of the middle of the oval and preferably slightly closer one end of the oval. By positioning the rectangular portion closer to one end of the oval structure, the arcuate portion of the other end of the clip can serve as a handle for the clip.

Figure 3:
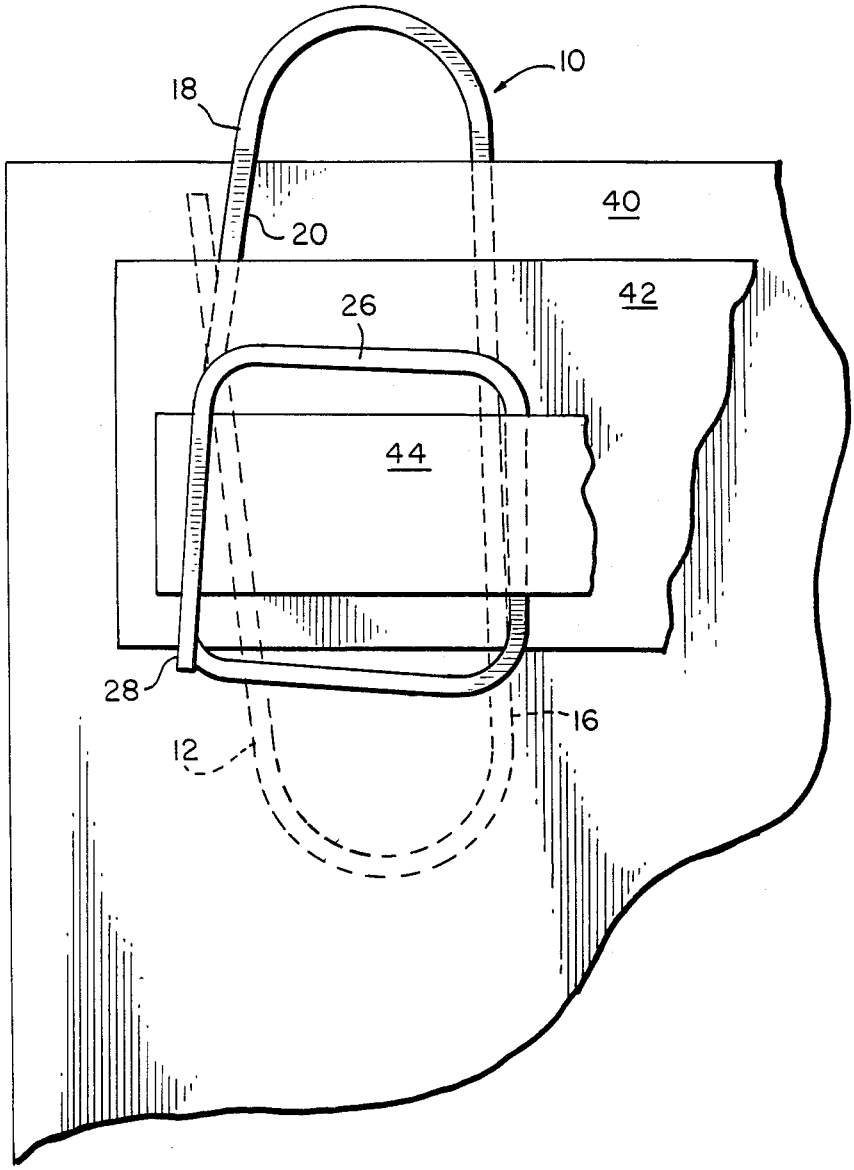
FIG. 3 is a fragmentary view of the clip device of FIG. 1 retaining a plurality of materials.

As a result of the overlay loop structure, the present clip serves not only the standard clipping function of other clips, but also serves to separate and organize multiple papers or other materials to be retained. FIG. 3 illustrates this advantageous characteristic. In FIG. 3, the clip 10 is shown retaining a variety of materials separated between its multiple loops. A first material 40 is retained beneath the second square loop 26 and on top of the arcuate loop 18. The material 40 is further held in place by being positioned between the first and third legs and the second and fourth legs, respectively. Next, a second material 42 is retained beneath loop 26 and is separated from the first material 40 by the third leg 20. Next, a third material 44 is clipped beneath the fifth leg 28. Though not shown in FIG. 3, a fourth material can be clipped by first leg 12 and separated from the first material 40 by the second leg 16. FIG. 3 also illustrates that the second arcuate portion 18 can serve as a handle for carrying or storing the clipped material. The clip retains these materials in an organized manner, separate from one another, and available for easy removal without disturbing the other materials. Thus, the clip allows the user to avoid the use of more bundlesome notebooks, folders or briefcases.

While the clip has been illustrated and described in the above manner, it is to be noted that the clip may be inverted and still perform as advantageously as previously noted.

A further important improvement of the present invention is that the clip is reversible. By reversible it is meant that the overlay structure, as illustrated in FIG. 2, can be reversed with the fifth leg 28 comprising the furthermost left part of the clip structure, followed by third leg 20, and then first leg 12. This reversal is achieved by threading the essentially rectangular portion 32 through the essentially oval structure 30. The fifth leg 28 is then threaded through the essentially rectangular portion 32. Threading, as described above, it necessary because, as previously discussed, the width of the square portion defined by the lower portions of the third leg 20, the first square loop portion 22, and the fourth leg 24 is at least equat to, and preferably greater than, the distance between the first leg 12 and the second leg 16. Furthermore, the fifth leg 28 must be threaded through the essentially rectangular portion 32 because the distance between the fifth leg 28 and the fourth leg 24 in the vicinity of the second square loop 26 is greater than the distance between the second leg 16 and third leg 20 in this same vicinity.

The advantage of this reversibility property is that the clip may be returned to its original clipping tension by reversing the structure, even if the clip has been deformed in excess of its elastic range in the original, unreversed structure. This will be noted as a significant improvement over existing paper clips in which excess deformation essentially renders the clip useless since the clipping tension is so markedly reduced. Because of its reversibility property, the present clip can retain relatively thick stacks of material without fear of excessive deformation.

The material from which the clip is made is not limited to a specific material, but simply requires that the material exhibit sufficient resiliency to retain the clipped material. Metal or resilient plastic are suggested materials.

Furthermore, the size of the clips and the individual loops is within the discretion of the manufacturer, to be based on the user's requirements.

While one embodiment of the invention has been described, it will be apparent to those skilled in the art that changes and modifications may be made without departing from the invention in its broader aspects. Therefore, the foregoing description is to be considered exemplary, rather than limiting, with the true scope of the invention being defined in the following claims.

What is claimed is:

1. A clip device for retaining and organizing articles in separate portions, allowing removal of one article without disturbing another, formed from a single, continuous length of multiply bent resilient material to define a plurality of loops, comprising:

(a) a first leg extending a first distance in a first direction from one end of the resilient material;

(b) a first generally arcuate portion extending from said first leg;

(c) a second leg extending from said arcuate portion a second distance in a second direction substantially opposite said first direction;

(d) a second generally arcuate portion extending from said second leg;

(e) a third leg extending from said second arcuate portion a third distance substantially in said first direction;

(f) a first rectangular loop portion extending from said third leg;

(g) a fourth leg extending from said first rectangular loop portion a fourth distance substantially in said second direction;

(h) a second rectangular loop portion extending from said fourth let;

(i) a first leg extending from said second rectangular loop a first distance substantially in said first direction;

(j) wherein said rectangular loop portions can be reversed to restore the clip device to its original tension.

2. A clip device as claimed in claim 1, wherein said second distance is greater than said first distance.

3. A clip device as claimed in claim 1, wherein said second distance is greater than said third distance.

4. A clip device as claimed in claim 1, wherein said third distance is greater than said fourth distance.

5. A clip device as claimed in claim 1, wherein said fourth and fifth distances are substantially equal.

6. A clip device as claimed in claim 1, wherein the distance between said second arcuate portion and said second rectangular loop portion is greater than the distance between said first arcuate portion and said first rectangular loop portion.

7. A clip device as claimed in claim 1, wherein said first and third legs occupy adjacent planes.

8. A clip device as claimed in claim 1, wherein said third and fifth legs occupy adjacent planes.

9. A clip device as claimed in claim 1, wherein said third leg occupies a plane interposed between the planes occupied by said first and fifth legs.

10. A clip device as claimed in claim 1, wherein said second and fourth legs occupy adjacent planes.

11. A clip device as defined in claim 1, wherein said rectangular loop portions are substantially square loop portions.

12. A clip device as defined in claim 1, wherein said resilient material is metal.

13. The clip device of claim 1, wherein the tension is adjustable by threading the essentially rectangular loop portions relative to said first and second legs.

14. The clip device of claim 1, wherein portions of said rectangular loop portions exert pressure on surfaces of said first and second legs.

15. The clip device of claim 1, wherein at least three points of said rectangular loop portions exert pressure on surfaces of said first and second legs.

* * * * *